US009711069B2

(12) United States Patent
Valentine

(10) Patent No.: US 9,711,069 B2
(45) Date of Patent: Jul. 18, 2017

(54) FREESTANDING DISPLAY

(71) Applicant: T3 Expo, LLC, Lakeville, MA (US)

(72) Inventor: Christopher Hugh Valentine, Marshfield, MA (US)

(73) Assignee: T3 Expo, LLC, Lakeview, MA (US)

( * ) Notice: Subject to any disclaimer, the term of this patent is extended or adjusted under 35 U.S.C. 154(b) by 0 days.

(21) Appl. No.: 15/332,900

(22) Filed: Oct. 24, 2016

(65) Prior Publication Data

US 2017/0116893 A1 Apr. 27, 2017

Related U.S. Application Data

(60) Provisional application No. 62/245,425, filed on Oct. 23, 2015.

(51) Int. Cl.

| | |
|---|---|
| ***G09F 7/00*** | (2006.01) |
| ***G09F 7/18*** | (2006.01) |
| ***G09F 15/00*** | (2006.01) |

(52) U.S. Cl.

CPC ..... *G09F 7/18* (2013.01); *G09F 15/0056* (2013.01); *G09F 2007/1856* (2013.01); *G09F 2007/1873* (2013.01)

(58) Field of Classification Search

CPC E01F 9/688; E01F 9/654; E01F 9/692; G09F 15/00; G09F 15/0062; G09F 15/0075; G09F 1/065

USPC ..... 40/603, 606.01

See application file for complete search history.

(56) References Cited

U.S. PATENT DOCUMENTS 3,618,556 A * 11/1971 Dittrich ..... E01F 9/654 116/63 C
3,835,308 A * 9/1974 Reese ..... F21V 3/023 362/124
4,019,271 A * 4/1977 Latimer ..... G09F 15/0037 116/63 P
5,572,818 A * 11/1996 Churchill ..... G02B 6/06 362/23.15
5,581,923 A * 12/1996 Brandstetter ..... G09F 1/12 248/447
5,786,665 A * 7/1998 Ohtsuki ..... G02B 6/0021 313/113
5,860,237 A * 1/1999 Johnson ..... G09F 15/0056 40/603
5,966,857 A * 10/1999 Pettersson ..... G09F 1/06 40/606.12
6,019,542 A * 2/2000 Bent ..... E01F 13/02 116/63 P
6,129,802 A * 10/2000 Key ..... G09F 11/23 156/229
6,981,817 B2 * 1/2006 Braverman ..... E01F 9/688 116/63 C (Continued)

*Primary Examiner* — Shin Kim

(74) *Attorney, Agent, or Firm* — Strategic Patents, P.C.

(57) ABSTRACT

A freestanding display system includes a weighted base removably and replaceably coupled to a relatively light-weight top portion bearing display surfaces. Because of the shape of the freestanding display and the significant weight differential between the weighted base and the top display portion, the center of mass for the freestanding display may be disposed within its volume such that the freestanding display resists tipping over when subjected to substantial tilt angles, while advantageously facilitating easy disassembly and transportation for deployment at tradeshows or similar temporary venues.

20 Claims, 5 Drawing Sheets

(56) References Cited

U.S. PATENT DOCUMENTS

| | | | | |
|---|---|---|---|---|
| 7,246,932 | B2 * | 7/2007 | Burtsev | G02B 6/0001 362/23.16 |
| 8,015,738 | B2 * | 9/2011 | Ernetoft | G09F 15/00 40/607.1 |
| 8,070,380 | B2 * | 12/2011 | Pucillo | E01F 9/688 404/10 |
| 8,234,804 | B1 * | 8/2012 | Rush | G09F 13/18 40/546 |
| 8,272,618 | B2 * | 9/2012 | Kilwin | F16B 11/006 248/346.01 |
| 8,607,488 | B2 * | 12/2013 | Johnston | G09F 15/0075 256/1 |
| 8,887,423 | B1 * | 11/2014 | Morgan | G08B 5/006 116/63 P |
| 2006/0113515 | A1 * | 6/2006 | Venegas, Jr. | E01F 15/003 256/1 |
| 2010/0199537 | A1 * | 8/2010 | Ernetoft | G09F 15/00 40/607.04 |
| 2011/0107635 | A1 * | 5/2011 | Walters | G09F 15/0075 40/612 |
| 2012/0090207 | A1 * | 4/2012 | Johnston | G09F 15/0075 40/606.01 |
| 2013/0074386 | A1 * | 3/2013 | Santarelli | G09F 23/06 40/606.01 |

* cited by examiner

FREESTANDING DISPLAY

RELATED APPLICATIONS

This application claims the benefit of U.S. Prov. App. No. 62/245,425 filed on Oct. 23, 2015, the entire content of which is incorporated herein by reference.

TECHNICAL FIELD

The present disclosure generally relates to a freestanding display, and more specifically to a freestanding tradeshow display with a weighted base.

BACKGROUND

Conventional tradeshow displays include a base engaged to one or more display panels, where the base includes protrusions for stability, e.g., disk-shaped stands, feet that protrude from the front and back of the display, and so forth. The remains a need for an improved freestanding tradeshow display system.

SUMMARY

A freestanding display system includes a weighted base removably and replaceably coupled to a relatively lightweight top portion bearing display surfaces. Because of the shape of the freestanding display and the significant weight differential between the weighted base and the top display portion, the center of mass for the freestanding display may be disposed within its volume such that the freestanding display resists tipping over when subjected to substantial tilt angles, while advantageously facilitating easy disassembly and transportation for deployment at tradeshows or similar temporary venues.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein.

DETAILED DESCRIPTION

Figure 1:
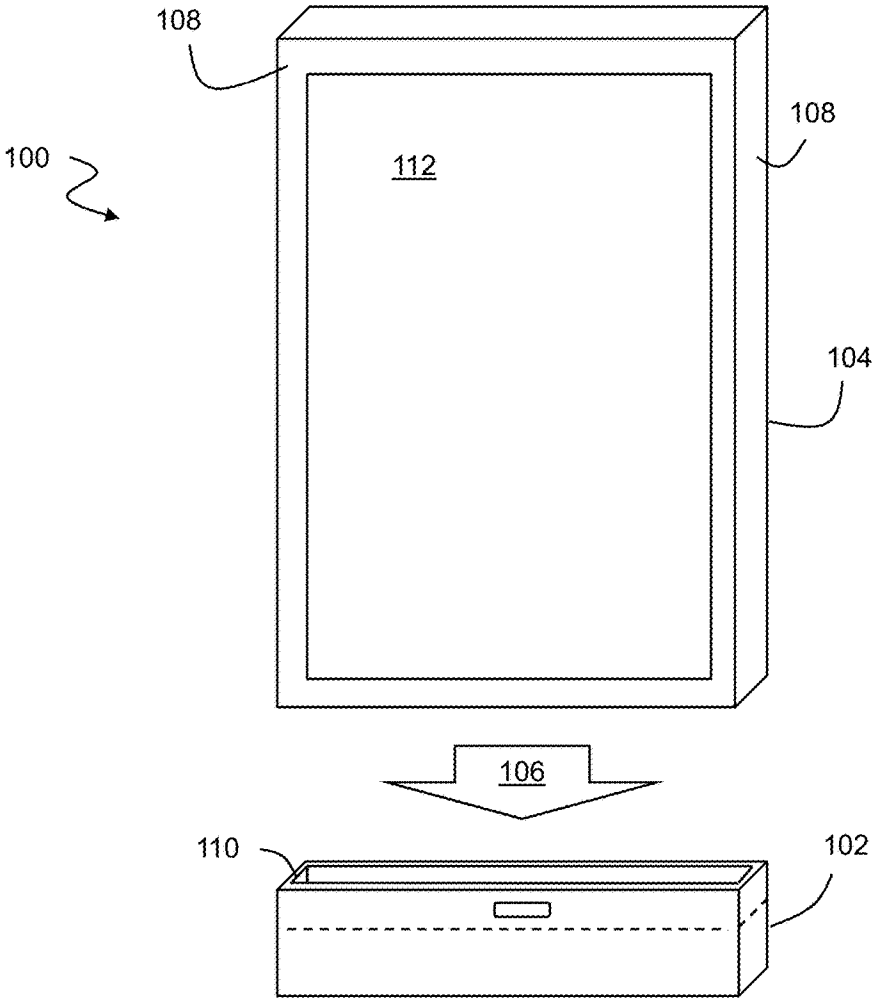
FIG. 1 shows a perspective view of a display system.

The embodiments will now be described more fully hereinafter with reference to the accompanying figures, in which preferred embodiments are shown. The foregoing may, however, be embodied in many different forms and should not be construed as limited to the illustrated embodiments set forth herein.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," "front," "back," and the like, are words of convenience and are not to be construed as limiting terms.

Described herein are devices, systems, and methods for a freestanding display. The "display," "system," "exhibit," or "display system," as described herein shall refer to a system for exhibiting or presenting one or more displays, which may include a base, one or more display panels, and associated structural frames. As used herein, a freestanding display exhibit refers generally to any of the display systems described herein where a base and display are in their assembled form for use as a display. The "display," "display panel," "display surface" or "panel" may be any item for presentation at, e.g., a tradeshow, convention, corporate event, sporting event, conference, exhibition, general event, retail store, restaurant, bar, or any other setting in which one might want to provide information or aesthetic content in a temporary or mobile physical form. The display may include, without limitation, a sign, graphic, advertisement, identification, poster, billboard, and so on. The display may further include, without limitation, lettering, designs, numbers, colors, graphics and the like.

FIG. 1 shows a perspective view of a display system. In general, the display system 100 may include a base 102 and a display 104. In general, the display 104 has an interior vertical cross-sectional shape (the cross sectional shape of the display 104 when viewed from the top as illustrated, e.g., in FIG. 7 below) that is shaped and sized to surround and conform to a corresponding exterior vertical cross-sectional shape of the base 102. In this manner, the display system 100 permits removal and replacement of the display 104 over the base 102 to form a freestanding exhibit (e.g., the assembled display system 100) by vertically sliding the display 104 over the base 102 as generally illustrated by an arrow 106. The display 104 generally includes one or more display surfaces 108 extending above a top 110 of the base 102 when the display 104 is placed for use over the base 102 (e.g., such that a bottom edge of the display 104 aligns with a bottom edge of the base 102 where both touch the ground).

The one or more display surfaces 108 may be rectangular as illustrated, or the display surfaces may have any other shape including any regular or irregular polygon or other shape suitable for a desired presentation. The display 104 may completely covers the base 102 to hide the base 102 from view when the display 104 is placed for use over the base 102 to form a freestanding exhibit. In general the display 104 may be coupled to the base 102 by a sliding engagement where the display 104 slides on top of the base 102 as described above. The display 104 may fully enclose the base 102, e.g., slide all the way down to the bottom of the base 102. The display 104 may also or instead sit fully or partially above the base 102. The coupling of the display 104 to the base 102 may rely on a friction fit between the two. The coupling may also or instead include the use of one or more of a ferromagnetic material, an adhesive, a mechanical coupling (e.g., hook and loop, latches, pins, screws, nails, etc.), and so forth. In an aspect, at least one of the base 102 and the display 104 includes a flange for the engagement of the display 104 to the base 102.

The display 104 may include a printed sheet 112 adhered to one of the display surfaces 108. The display may also or instead include digital or other dynamic signage of any suitable form including, without limitation, a computer screen, an LED screen, an OLED screen, a plasma screen, an LCD screen, and so on. The display may also or instead include electrical components including, without limitation, light fixtures, clocks, LEDs, tickers, and the like. The display may also include interactive or moving elements. The display may be made from any material known in the art or that will become known in the art, including, without limitation, paper, wood, foam, plastic (e.g., corrugated plastic), cardboard, honeycomb cardboard, metal, and so on. The display, display panels, base, or structural components may also be magnetic or nonmagnetic. The displays may include temporary displays such as temporary booths, exhibits, showcases, partitions, and the like. The displays may also be interchangeable, movable, and/or adaptable (e.g., able to change size, shape, setting, appearance, etc.).

The display 104 may also or instead include ridges, flanges or the like for aligning display materials that are magnetically attached or otherwise removably positioned on the display surface 108.

Figure 2:
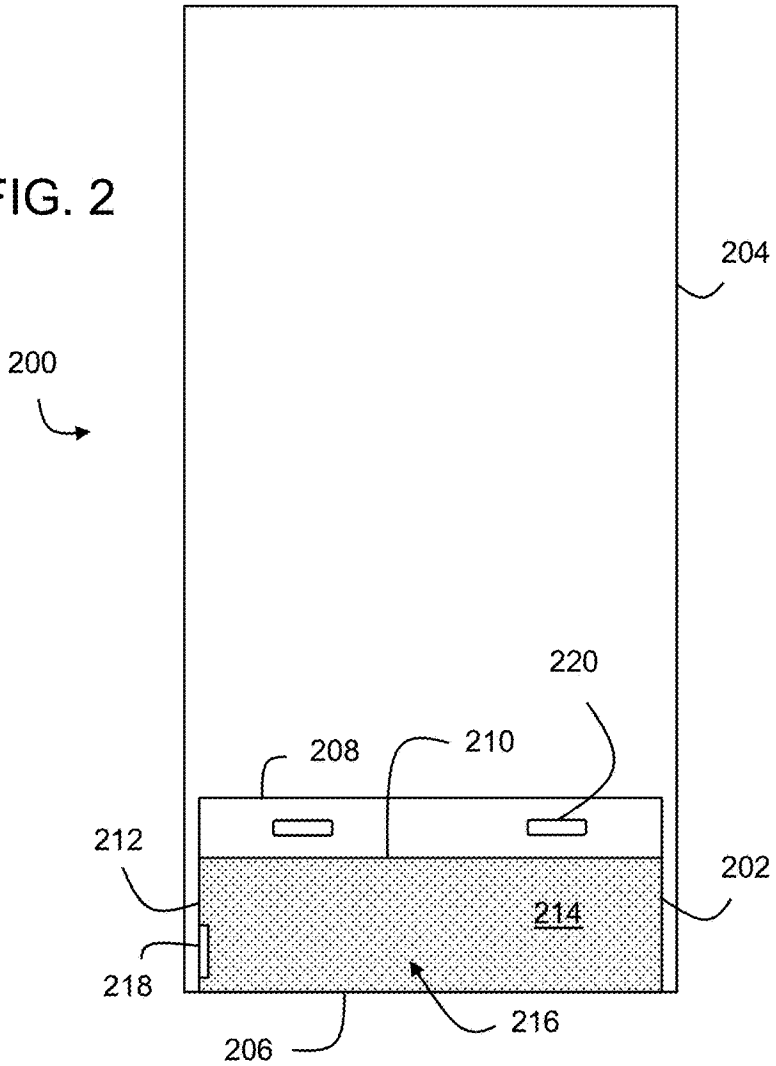
FIG. 2 is a front cross-sectional view of a display system.

FIG. 2 is a front cross-sectional view of a display system 200, which may for example include any of the display systems described above, in which a base 202 and a display 204 are assembled together to form a freestanding exhibit.

The base 202 may generally include a bottom shelf 206, a top 208, a vertical interior shelf 210 below the top 208, and one or more sidewalls 212. The one or more sidewalls 212 may be arranged into an exterior vertical cross-sectional shape of any desired form, as discussed in greater detail with reference to FIG. 7 below. The vertical interior shelf 210, the bottom 206, and the one or more sidewalls 212 may collectively form a closed void 214 in an interior space formed there between.

There may be a weighted material 216 within the closed void 214 to provide stability to the display structure 200, such as a sand, a concrete, a dense foam, rocks, or the like. In another aspect, the closed void may be watertight, and the weighted material may include a fluid such as water. The base 202 may also include a hatch 218 or similar sealable closure for accessing the void space so that sand, water, or other weighted material can be added to or removed from the void space as desired.

The base 202 may include at least one handle 220 for convenient handling and transportation thereof. The handle 220 may, for example, be formed by an opening in one of the sidewalls 212 and may be positioned below the top 208 and above the vertical interior shelf 210 to permit convenient gripping from a position above the center of gravity of the base 202.

Figure 3:
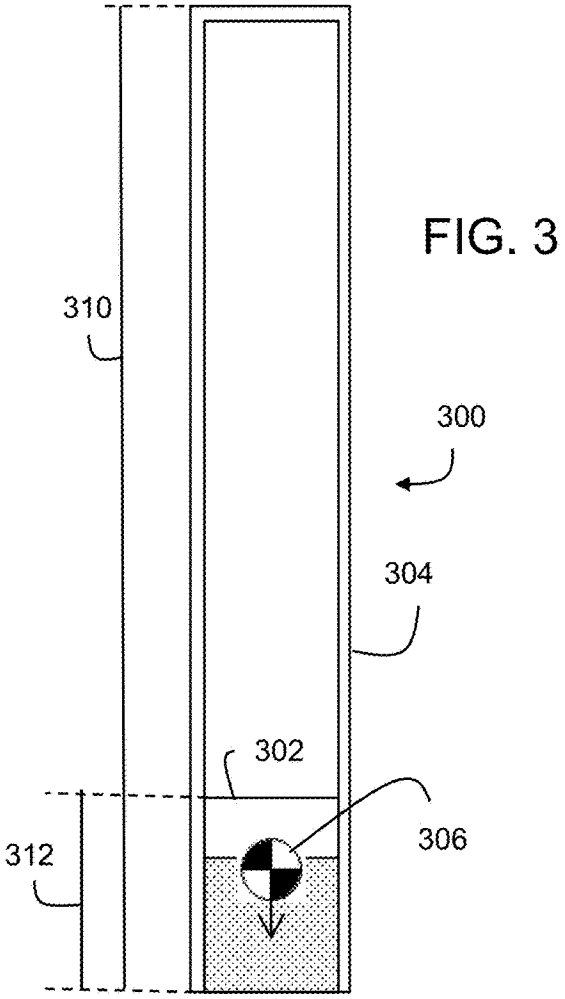
FIG. 3 is a side cross-sectional view of a display system.

FIG. 3 is a side cross-sectional view of a display system 300. The display system 300 may include a base 302 and a display 304 such as any of the bases and displays described above. In general, the display 304 may be substantially lighter than the base 302. In general, a center of mass 306 of the freestanding exhibit formed by the display system 300 is disposed within a volume of the freestanding exhibit at a location dominated by the weighted material of the base so that the freestanding exhibit resists tipping over when subjected to substantial tilt angles. This permits the use of relatively tall, lightweight display structures that will remain stable during ordinary use. For example, the display 304 may have a first height 310 at least four times greater than a second height 312 of the base 302.

Figure 4:
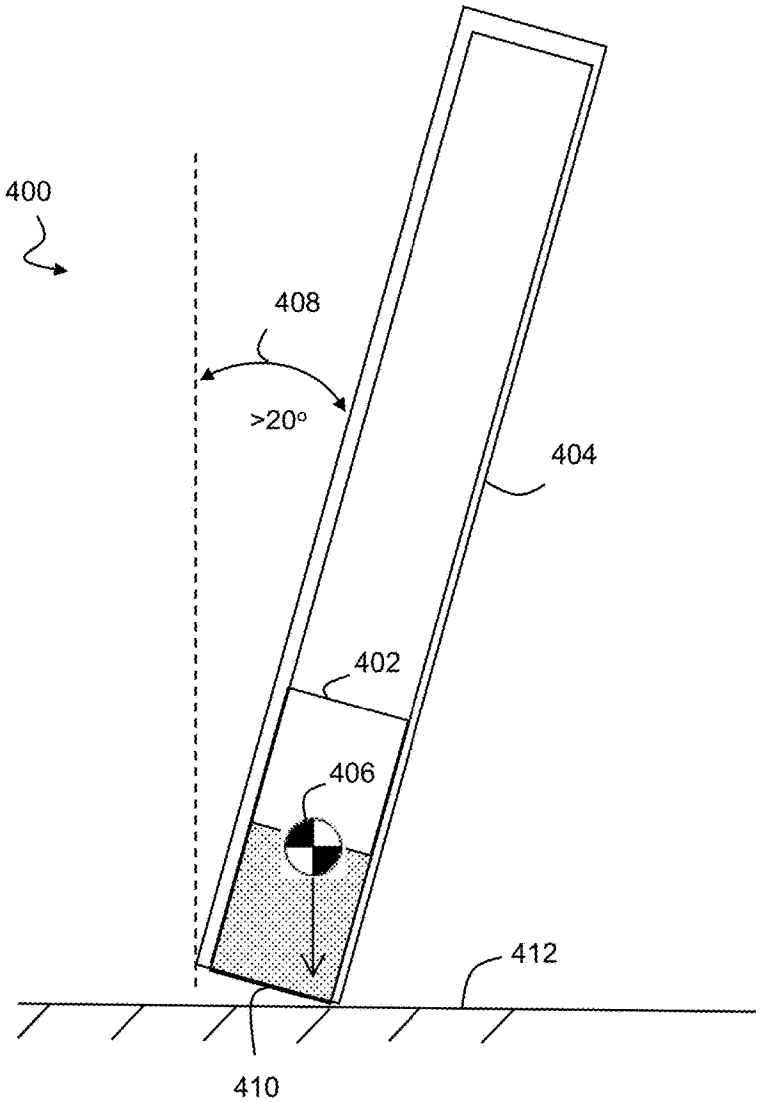
FIG. 4 shows a tilted display system.

FIG. 4 shows a tilted display system. As described above, the display system 400 is weighted in the base 402 so that a center of gravity 406 resists tipping over when subject to a substantial tilt angle 408, more specifically because the center of gravity 406 remains inside a perimeter of a bottom surface 410 of the base 402, as generally illustrated in FIG. 4. The tilt angle 408 is generally an angle between a vertical line and a side of the display system 400, or an angle off normal from a ground plane 410. The display system 400 may usefully resist tipping over at a tilt angle of at least fifteen degrees. More generally, the center of mass of the freestanding exhibit may be disposed within the volume of the freestanding exhibit such that the freestanding exhibit resists tipping over when subjected to a tilt angle of more than twenty degrees, or at least twenty five degrees, or any other suitable angle.

In general, the maximum stable tilt angle may be controlled by the geometry of the base, the amount of weighted material, and so forth. For example, the base 402 may have a first weight at least four time greater than a second weight of the display 404, e.g., to lower the center of gravity toward the bottom surface 410 of the base 402 for improved stability. Similarly as noted above, the display 404 may be substantially taller than the base 402, e.g., four times taller or more.

Figure 5:
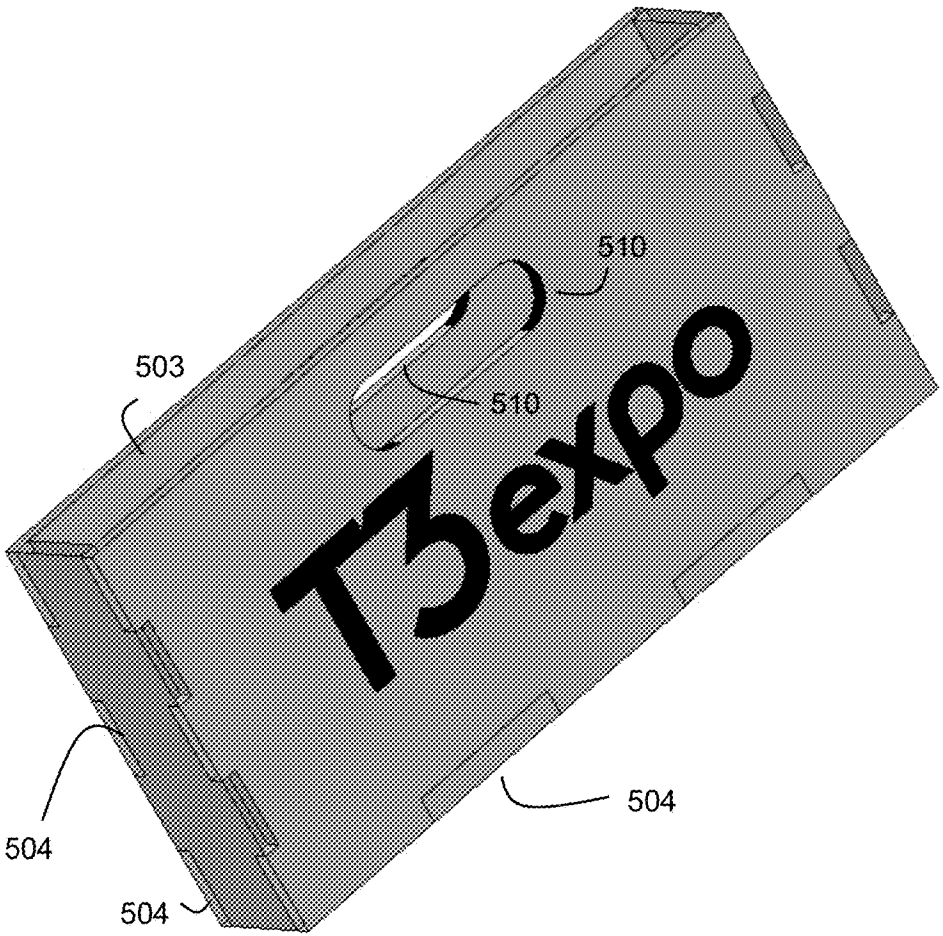
FIG. 5 shows a base for a display system.

FIG. 5 shows a base for a display system, such as any of the bases described above. The base 502 may be conveniently fabricated from sheets of material 503 that can be dovetailed together with friction fit engagement at interlocking segments 504. As a significant advantage, this permits disassembly of each base 502 into a compact, stackable group of sheets of material. The sheets may be advantageously fabricated with a sufficiently tight fit to retain a weighted material such as sand or rocks without the need for a liner or additional material. In another aspect any of the bases described herein may instead be fabricated directly of a dense material such as metal, stone or the like, so that additional weighted material is not required. As illustrated in FIG. 5, the base 502 may include two handles 510, however the base 502 may more generally include a plurality of handles such as four, six, eight, or any other convenient number of handles in any suitable size or shape.

Figure 6:
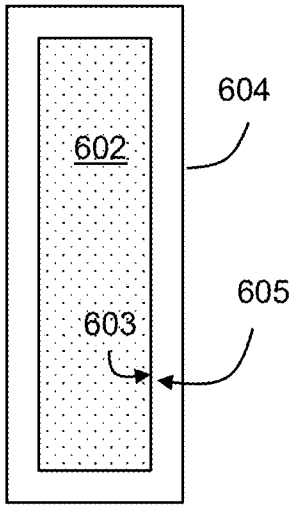
FIG. 6 is a top cross-sectional view of a display system.

FIG. 6 is a top cross-sectional view of a display system such as any of the display systems described herein. In general, the base 602 may include an exterior vertical cross-sectional shape 603, and the display 604 may include an interior vertical cross-sectional shape 605. The display 604 may form a friction fit with the base 602 when placed thereupon by closely matching the dimensions of these shapes to one another. The exterior vertical cross sectional shape 603 of the base 602 may include a polyhedron, such as the rectangle illustrated in FIG. 6. The interior vertical cross-sectional shape 605 of the display 604 may have a corresponding shape matched to fit around the base. The exterior vertical cross-sectional shape may also or instead include at least one curved edge.

More generally, the interior vertical cross-sectional shape 605 of the display 604 and the exterior vertical cross-sectional shape 603 of the base 602 may have any suitable shape for use with the display systems contemplated herein. In one aspect, at least one of the base 602 and the display 604 include a polyhedron shape, e.g., a rectangular hexahedron (i.e., rectangular box where each face is a rectangle), a rectangular prism, a cube, or a cuboid. One skilled in the art will recognize that an infinite number of shapes are possible for the display surfaces and vertical cross-sections of the base 602 and the display 604, including without limitation, a hexahedron (i.e., a polyhedron with six faces), a cylinder, a prism having a polygonal cross-section, a pyramid (e.g., with a polygonal base such as a square, rectangle, triangle, and so forth), a cone, a sphere, a barrel shape, a wedge shape, a truncated shape, an ellipsoid, a symmetrical shape, an asymmetrical shape, and so forth. The shape of at least one of the base 602 and the display 604 may also or instead include a combination of any of the foregoing shapes or other shapes known in the art, e.g., the freestanding display may have an I-shaped cross-section.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A display system comprising:

a base including a bottom shelf, a top, a vertical interior shelf below the top, one or more sidewalls forming an exterior vertical cross-sectional shape, and a closed void in an interior space formed within the bottom shelf, the vertical interior shelf, and the one or more sidewalls;

a weighted material within the closed void;

at least one handle for the base, the at least one handle formed by an opening in the one or more sidewalls at a location below the top and above the vertical interior shelf; and a display having an interior vertical cross-sectional shape that is shaped and sized to surround and conform to the exterior vertical cross-sectional shape of the base, thereby permitting removal and replacement of the display over the base to form a freestanding exhibit by vertically sliding the display over the base, wherein the display includes one or more display surfaces extending above the top of the base when the display is placed over the base, wherein the display is substantially lighter than the base, and further wherein a center of mass of the freestanding exhibit is disposed within a volume of the freestanding exhibit such that the freestanding exhibit resists tipping over when subjected to a tilt angle of at least fifteen degrees.

2. The display system of claim 1 wherein the weighted material includes sand.

3. The display system of claim 1 wherein the weighted material includes concrete.

4. The display system of claim 1 wherein the weighted material includes dense foam.

5. The display system of claim 1 wherein the closed void is watertight, and wherein the weighted material includes a fluid.

6. The display system of claim 1 wherein the base includes a hatch for accessing the closed void to add or remove weighted material.

7. The display system of claim 1 wherein the center of mass of the freestanding exhibit is disposed within the volume of the freestanding exhibit such that the freestanding exhibit resists tipping over when subjected to a tilt angle of more than twenty degrees.

8. The display system of claim 1 wherein the center of mass of the freestanding exhibit is disposed within the volume of the freestanding exhibit such that the freestanding exhibit resists tipping over when subjected to a tilt angle of at least twenty five degrees.

9. The display system of claim 1 wherein the display surfaces are structurally formed from at least one of a foam, a corrugated plastic, and a cardboard honeycomb.

10. The display system of claim 9 further comprising a printed sheet adhered to one of the display surfaces.

11. The display system of claim 1 wherein the display forms a friction fit with the base when placed thereupon.

12. The display system of claim 11 wherein the exterior vertical cross-sectional shape includes a polyhedron.

13. The display system of claim 11 wherein the exterior vertical cross-sectional shape is a rectangle.

14. The display system of claim 11 wherein the exterior vertical cross-sectional shape includes at least one curved edge.

15. The display system of claim 1 wherein the one or more display surfaces are rectangular.

16. The display system of claim 1 wherein the display completely covers the base to hide the base from view when the display is placed for use over the base.

17. The display system of claim 1 wherein the base has a first weight at least four times greater than a second weight of the display.

18. The display system of claim 1 wherein the display has a first height at least four times greater than a second height of the base.

19. The display system of claim 1 wherein the freestanding exhibit is a tradeshow display unit.

20. The display system of claim 1 wherein the base includes a plurality of handles.

* * * * *